US005588902A

United States Patent [19]

Tominaga et al.

[11] Patent Number: 5,588,902

[45] Date of Patent: Dec. 31, 1996

[54] APPARATUS FOR POLISHING WAFERS

[75] Inventors: Hiroyoshi Tominaga; Yoshinori Suzuki, both of Fukushima-ken, Japan

[73] Assignee: Shin-Etsu Handotai Co., Ltd., Tokyo, Japan

[21] Appl. No.: 387,514

[22] Filed: Feb. 13, 1995

[30] Foreign Application Priority Data

Feb. 18, 1994 [JP] Japan ..... 6-044839

[51] Int. Cl.[6] ..... B24B 5/00

[52] U.S. Cl. ..... 451/288; 451/285; 451/398

[58] Field of Search ..... 451/364, 397, 451/398, 400, 402, 41, 278, 283, 285, 287, 288

[56] References Cited

U.S. PATENT DOCUMENTS

| | | | |
|---|---|---|---|
| 4,270,316 | 6/1981 | Krämer et al. | 451/41 |
| 4,521,995 | 6/1985 | Sekiya . | |
| 5,036,630 | 8/1991 | Kaanta et al. | 451/41 |
| 5,081,795 | 1/1992 | Tanaka et al. | 451/288 |

FOREIGN PATENT DOCUMENTS

| | | |
|---|---|---|
| 0362811 | 10/1989 | European Pat. Off. . |
| 3120477 | 5/1981 | Germany . |
| 2058620 | 8/1980 | United Kingdom . |

*Primary Examiner*—Bruce M. Kisliuk
*Assistant Examiner*—Eileen P. Morgan
*Attorney, Agent, or Firm*—Barnes & Thornburg

[57] ABSTRACT

The present invention provides an apparatus for polishing wafers, wherein high work efficiency in handling a polishing plate is achieved with high flatness finish of the polished wafers.

The apparatus has a polishing plate composed of two plates, which are superimposed in tight adhesion with each other. The thickness of the polishing plate is adjusted to such a value that the polished wafers may be finished with high flatness across the polished surface. An upper plate is mounted to a top ring by means of a a plurality of rigid supporting member consisting of a hook-shaped plate holding portion and a top ring fixing portion such that a predetermined clearance is left between the upper surface of the upper plate and a flexible thin plate arranged on the lower portion of the top ring. The upper and lower plates are polished to be flat and smooth across one side surface to be superimposed of each thereof and then the upper plate and lower plate are superimposed with each other in tight adhesion by surface tension of a liquid.

17 Claims, 4 Drawing Sheets

APPARATUS FOR POLISHING WAFERS

BACKGROUND OF THE INVENTION

1. Field of the Invention

The present invention relates to an apparatus for polishing wafers such as are made of single crystals of silicon or a compound semiconductor, or are made of ceramic like quartz and more particularly, to the apparatus for polishing wafers wherein the wafers are polished in batch processing mode while being adhered to a polishing plate.

2. Description of the Prior Art

There is well known an polishing apparatus, for example, as illustrated in FIG. 5 as polishing apparatuses of the above-mentioned kind. The apparatus, which is of a fluid pressure type as for a polishing down load, comprises a hollow top ring 22 fast held to the lower end of the rotary shaft 21, a flexible thin plate 23 secured to the lower end of the top ring 22 so as to form a sealed space 24 and a supply pass 25 for pressurized fluid arranged inside the rotary shaft 21, which communicates with the sealed space 24.

The above-mentioned thin plate 23 is a pressure diaphragm made from a soft material such as rubber and like that and for use in pressurizing the polishing plate 26 made from a plate with high rigidity such as a grass plate or ceramic plate, which the wafers W are mounted to.

The operation of the polishing apparatus will now explained below with reference to FIG. 5. The polishing plate 26, to which the wafers W are mounted, is placed in position on the polishing pad 32 mounted on the platen 31, then the top ring 22 is moved down to a position at which the surfaces of the wafers W to be polished are very close to and in a parallel relation with the polishing pad 32, and further in succession thereto pressurized fluid is supplied to the sealed space 24 from a supply source (not shown) of pressurized fluid.

In this condition, a load with uniform distribution is applied across the thin plate 23 by fluid pressure of the sealed space 24 and thereby both the thin plate 23 and the polishing plate 26 are displaced toward the side of the polishing pad 32, so that the surfaces of the wafers W to be polished are pressed to the polishing pad 32 for polishing.

There is a problem inherited by the polishing apparatus, which is of a pressure type of a load with uniform distribution across the thin plate 23 and the polishing plate 26, which is that local sinks by deformation occur in areas in the lateral expanses of the plates 23, 26 where the wafers W are not mounted, as illustrated in FIG. 6. The local sinking causes deterioration of the flatness of the wafers W and in more particular, opposite portions along the periphery of the wafers in the direction of rotation of the polishing plate 26, that is, the hatched portions of the periphery of the wafers are more polished off than the other portions thereof as shown in FIG. 7 only to affect the flatness unfavorably, so that it is very hard to acquire polished wafers with high flatness.

There has been used as the above-mentioned polishing plate 26 the same made from a high-rigidity material having such a thickness that the local sinking does not occur by deformation during wafer polishing operation.

A harmful influence to the work efficiency was observed clearly, however, with such a polishing plate 26, which is heavy to a considerable extent, in handling, especially, positioning on the polishing pad 32 or removing from the polishing pad 32.

SUMMARY OF THE INVENTION

The present invention was made in view of the prior art technology above-mentioned and has an object to provide an apparatus for polishing wafers, which makes it possible to solve the problem raised by the use of the above-mentioned polishing plate 26 with high rigidity, which is heavy to a considerable extent, and at the same time which makes it possible to acquire polished wafers with high flatness as well.

The apparatus for polishing wafers of a first feature according to the present invention having a polishing plate made from a material with high rigidity for adhering wafers thereto, characterized in that: the polishing plate composed of two plates in tight adhesion superimposed with each other; the total thickness of the two plates is adjusted to an extent with which polished wafers may be obtained with quality flatness enough for the use in current high-density integrated circuitry; and the upper plate is mounted to the lower portion of the top ring of the polishing apparatus.

The apparatus for polishing wafers of a second feature according to the present invention, further characterized in that: a flexible thin plate is secured to the lower portion of the top ring so as to form a sealed space within the top ring; the sealed space communicates with a supply source of pressurized fluid such as air or other gases, or water or other liquids; and the upper plate being part of the above-mentioned polishing plate is positioned in a relation spaced apart in a predetermined distance (as for the distance, the explanation will be given later) with the lower surface of the thin plate.

The apparatus for polishing wafers of a third feature according to the present invention, further characterized in that: the two plates, which are the constituents of the polishing plate, are polished to be flat and smooth across the one side surface of each thereof to be superimposed; and the two plates are adhered to each other by surface tension of a liquid.

The apparatus for polishing wafers of a fourth feature according to the present invention, further characterized in that: the adhering liquid is introduced into or removed from at least one of the superimposing surfaces of the superimposed two plates constituting the polishing plate by means of channels arranged in the surface; all the channels communicate with each other at a point around the center thereof, disposed in such a manner that each runs on the surface along a straight line or a parabolic curve from a point around the center, are symmetrical with respect to the center; and the other end of each of the channels forms an opening at the periphery of the plate, where the channels terminate.

Polished wafers are easily obtained with high flatness by the polishing apparatus of the first feature according to the present invention on account of the fact that the polishing plate is made from a material with high rigidity and the thickness is adjusted to be a predetermined value.

Besides, the polishing plate is composed of two plates superimposed with each other, one is mounted to the lower portion of the top ring of the polishing apparatus, the other is positioned on the polishing pad during polishing operation, and the two plates are adhered to each other by the surface tension of a liquid under the condition where the liquid such as water is interposed therebetween by being introduced in the plate which is mounted to the top ring, so that the polishing plate according to the present invention is much lighter compared with the polishing plate of the traditional technique being one plate and therefore work efficiency is much improved in the following steps such as placing the lower plate on the polishing pad, removing the same from the polishing pad and separating the same from the upper plate mounted to the top ring on completion of polishing.

A load with uniform distribution is applied across the flexible thin plate by means of the pressure of the sealed space generated with the pressured fluid supplied into therein in the apparatus for polishing wafers of the second feature according to the present invention. In this case, the upper plate is mounted to the top ring in a position spaced apart by a predetermined distance from the lower surface of the thin plate by means of a supporting member with rigidity, so that the polishing plate may be three-dimensionally displaced in conformity with displacement of the thin plate and the wafers are polished across the surface to be polished while being pressed onto the polishing pad. In the situation of the usage of the polishing apparatus according to the present invention, the flatness of the polished wafers are improved as compared with that in a situation where the polishing plate is mounted to the hard lower portion of the top ring of the polishing apparatus, contacting directly thereto.

The two plates are adhered to each other by surface tension of a liquid in the apparatus for polishing wafers of the third feature according to the present invention and thus the polishing plate may be set up to the polishing apparatus with ease without the usage of fixturing members such as bolts for joining the two plates.

The openings arranged along the periphery of the polishing plate are used in the apparatus for polishing wafers of the fourth feature according to the present invention for the purpose that a pressured gas or pressured liquid is supplied in through the openings, or in the other case the liquid for adhesion held between the plates is removed out by suction through the same openings and thus the lower plate is easily separated from the upper plate.

BRIEF DESCRIPTION OF THE DRAWINGS

Other features and objects of the present invention will become apparent from a study of the following description of an apparatus for polishing wafers such as are made from single crystals of silicon or a compound semiconductor, or are made from ceramic like quartz, wherein the wafers are polished in batch processing mode while being adhered to a polishing plate, together with the accompanying drawings, of which.

DETAILED DESCRIPTION OF THE PREFERRED EMBODIMENT

Below described in reference to the drawings is an embodiment of the present invention.

Figure 1:
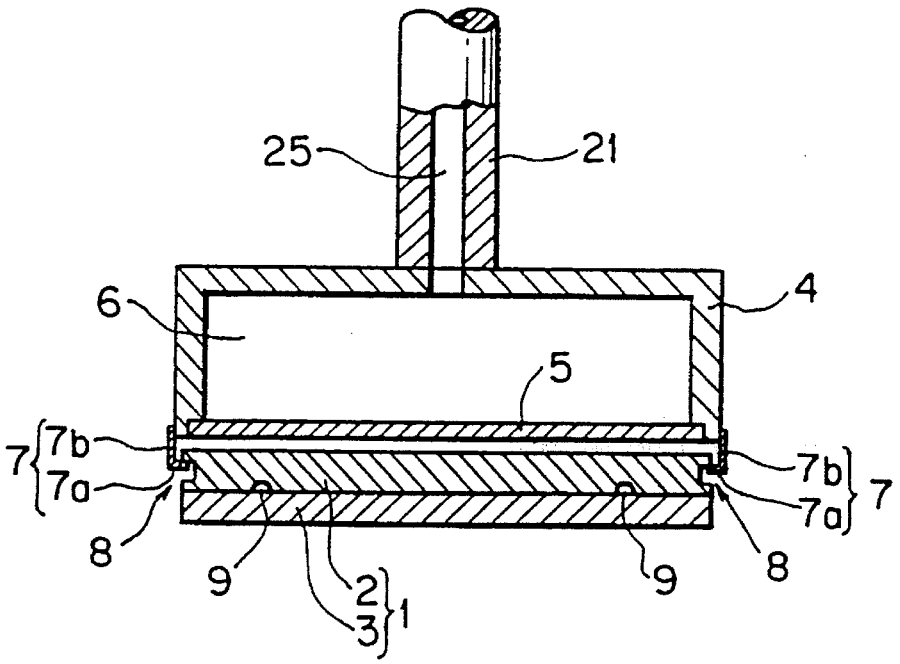
FIG. 1 is a schematic sectional view illustrating an embodiment of the main portion of the apparatus for polishing wafers according to the present invention.
Figure 2:
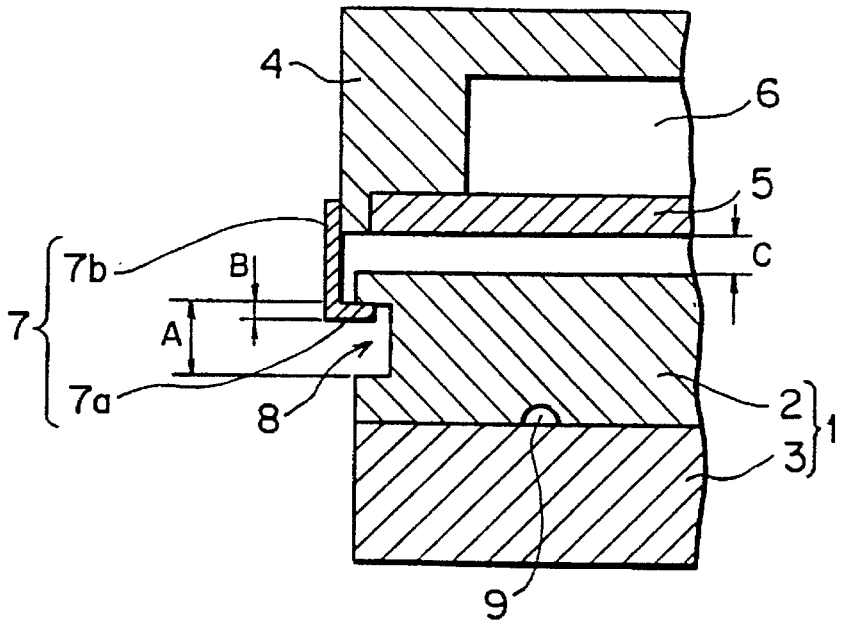
FIG. 2 is an enlarged partial schematic view of FIG. 1.

The apparatus for polishing wafers as shown in FIG. 1 is equipped with a polishing plate 1 made from a material with high rigidity such as ceramic or glass, which is used for adhering wafers, for example, made from silicon thereto. The same polishing plate 1 is composed of two plate 2,3, which are superimposed in tight adhesion with each other and the total thickness of the two plates is adjusted to an extent with which polished wafers may be obtained with quality flatness enough for the use in current high-density integrated circuitry, which means that the polishing plate 1 is thick enough not to be deformed by the polishing load. The upper plate 2 is mounted to the top ring 4 of the polishing apparatus by way of a supporting member(s) 7 interposing therebetween.

The total thickness of the plates 2,3 is set up at a value obtained through a theory or experiments, where individual thicknesses may fall within 10 mm~20 mm for the upper plate 2, 10 mm~15 mm for the lower plate 3 and 20 mm~30 mm in total for the plates combined depending on the material forming the polishing plate 1. In a particular case of the polishing plate 1 having a diameter of 520 mm made from alumina ceramic, the upper plate 2 is about 15 mm thick and the lower plate 3 is about 10 mm.

Figure 5:
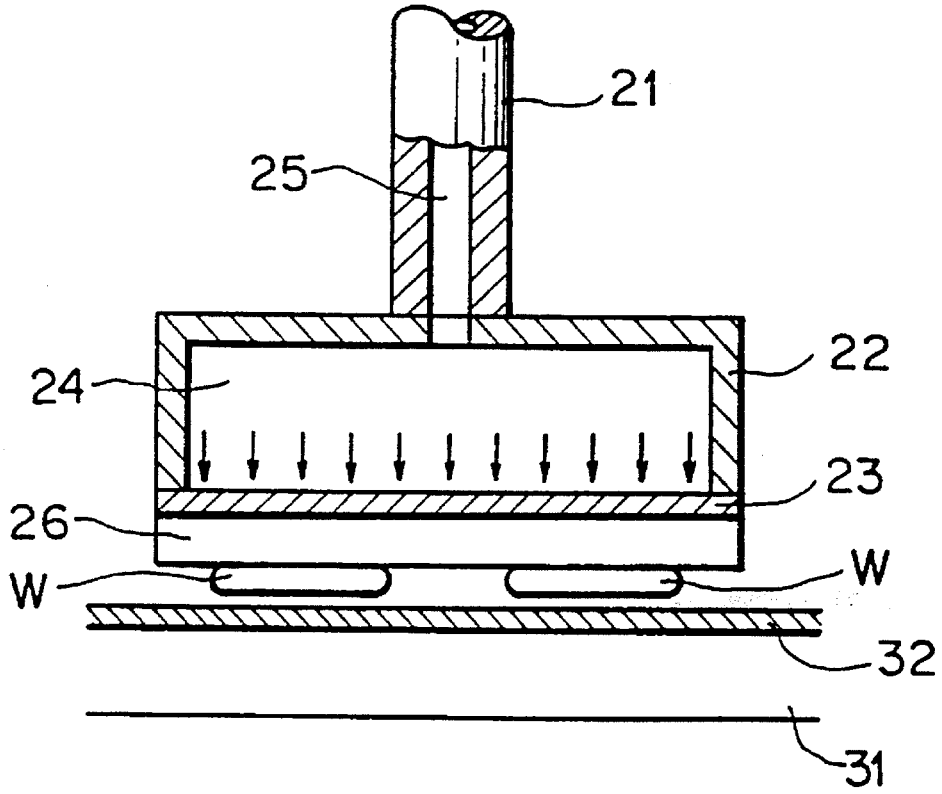
FIG. 5 is a schematic sectional view illustrating the main portion of an apparatus for polishing wafers according to the prior art.
Figure 6:
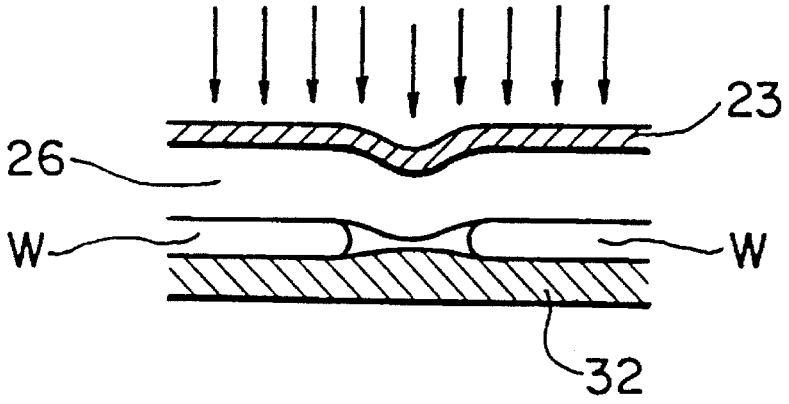
FIG. 6 is an illustration of polishing action of a wafer in the apparatus as shown in FIG. 5.
Figure 7:
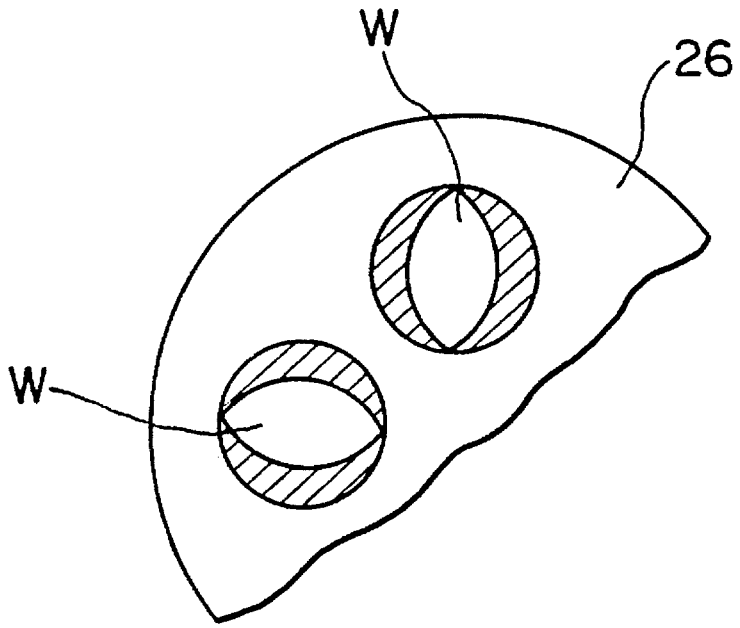
FIG. 7 is an illustration of the condition of some of the wafers after being polished by the apparatus as shown in FIG. 5.

The top ring 4 has the same structure as that 22 as shown in FIG. 5 and it is secured to the lower end of a rotary shaft 21. A flexible thin plate 5 is held fast on the lower end of the top ring 4 to form a sealed space 6 therein. The sealed space 6 communicates with a supply pass 25 for pressurized fluid arranged inside the rotary shaft 21.

The thin plate 5 is a plate made from elastic material such as rubber, or hard material such as metal or hard plastic. In the latter case, the thin plate 5 made from hard material such as metal or hard plastic is provided with flexibility by being processed thinner enough than the thin plate 5 made from softer material such as rubber.

Hook-shaped plate holding portions 7*a* and top-ring fixing portions 7*b* constitute a plurality of supporting members 7 made from rigid material, which are fixed along the periphery of the lower end of the top ring 4 with a plurality of the top-ring fixing portions 7*b*. The hook-shaped plate holding portions 7*a* are engaged along the periphery of the upper plate 2 constituting in part the polishing plate 1. A plurality of the holding members 7 are arranged along the periphery in symmetry with respect to the central axis of the top ring 4, whereby the plate 2 is connected with the top ring 4 in a position spaced apart by a predetermined distance from the lower surface of the thin plate 5.

In this case, the predetermined distance above-mentioned is set up such that the upper plate 2 becomes free of the hook-shaped plate holding portions 7*a* and the top ring 4 presses the upper plate 2 and then the lower plate to a polishing pad (not shown), when the top ring 4 is moved down. The magnitude of the predetermined distance is in the range of 0.5 mm~5 mm, where practically, for example, about 1 mm is selected. When the width of an annular channel 8 along the periphery of the upper plate 2 is designated as A, the thickness of the hook-shaped plate holding potion 7*a* as B and the clearance between the lower surface of the thin plate 5 and the upper surface of the upper plate 2 as C, the following condition has to be satisfied according to the present invention that the difference between A and B, that is, A–B is a positive value and larger than C.

There may be arranged a plurality of holes at the positions along the periphery of the upper plate 2, where a plurality of the supporting members 7 are arranged respectively, instead of the annular channel 8 along the periphery of the upper plate 2. And each of the holes is with the width A, wherein the hook-shape plate holding portion 7*a* serves the purpose and is adapted to be movable.

The surfaces to be superimposed of the plates are polished to be flat and smooth, and thereafter they are superimposed in close face-to-face contact to be held fast to each other. A method is applicable that bolts are used as fixing members, but another method is preferred due to easiness that the two plates 2,3 are superimposed to each other in the presence of water spread across between the plates 2,3 and adhered by surface tension of the water.

Figure 3:
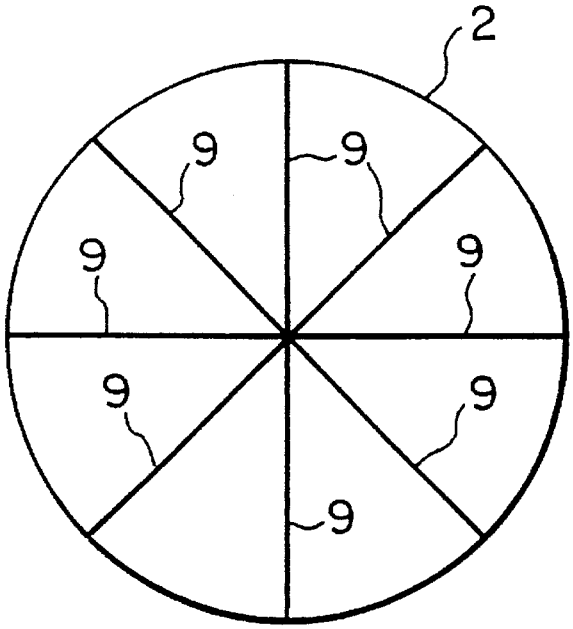
FIG. 3 is a schematic bottom plan view illustrating an embodiment of the plate according to the present invention.
Figure 4:
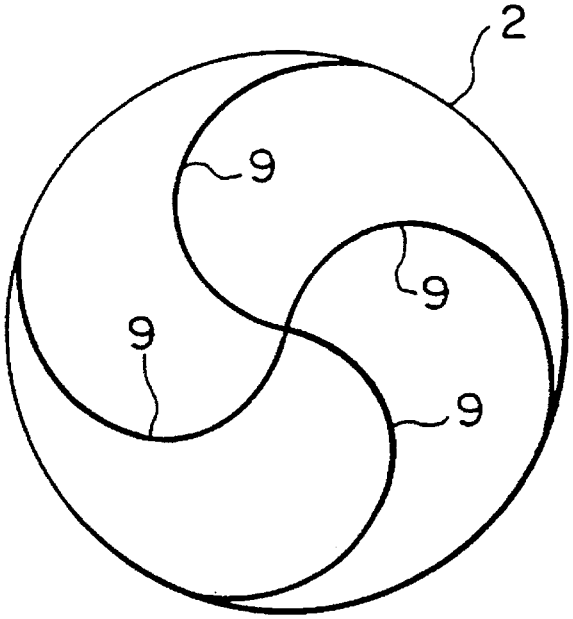
FIG. 4 is a schematic bottom plan view illustrating another embodiment of the plate according to the present invention.

In the case that the plates 2,3 are adhered to each other, at least one of the surfaces to be superimposed is provided with channels formed therein for introduction or removal of a liquid for adhesion and an end of each of the channel is terminated at the periphery of the plate forming an opening there. An arrangement of the channels 9 for introduction or removal is shown in FIG. 3, where the channels 9 are arranged in such a manner that each runs along a straight line from the center of the lower surface of the upper plate 2 and another arrangement of the channels 9 for introduction or removal is shown in FIG. 4, where the channels 9 are arranged in such a manner that each runs along a parabolic curve from the center of the lower surface of the upper plate 2. The channels 9 for introduction or removal have, for example, a semi-circle with a round bottom of 2 mm~3 mm in radius in a traverse section and converge at a point around the center of the surface to communicate with each other, while the channels are preferably arranged in such a manner as to be symmetrical with respect to the point of convergence around the center.

The plate 3 is separated from the plate 2 by removal of the adhering liquid from the channels 9 for introduction or removal, or as alternative by pressing an additional amount of the adhering liquid into the channels 9 for introduction or removal.

In the latter case, the tip(s) of a jet nozzle(s) (not shown) is inserted into one or more of the openings of the channels for introduction or removal, while the top ring is in a position raised a little above the polishing pad on completion of polishing operation and in succession pressured air or pressured water is supplied to the channels 9 for introduction or removal. Then the plate 3 is separated from the plate 2 for certain since the supplied pressured fluid is spread into all of a plurality of the channels 9 for introduction or removal.

Instead of the polishing apparatus as shown in FIG. 1, which is of a pressure type of a load with uniform distribution across the polishing plate 1, A top ring 4 may have a structure, where the surface is made from hard material and is directly overlapped on and fixed to the polishing plate 1.

Adhesion of wafers on the lower surface of the lower plate 3 is carried out with well-known methods as the prior art such as the so-called wax-mounting or waxless-mounting methods.

In the polishing apparatus as shown in FIG. 1, with supply of the pressurized fluid into the sealed space 6, the thin plate 5 is brought into a situation under the influence of a load with uniform distribution by pressure of the sealed space 6 and the polishing plate 1 is displaced three-dimensionally toward the polishing pad in conformity with displacement of the thin plate 5 so that the wafers may be polished across the surface to be polished by being pressed to the polishing pad. Consequently, flatness of the polished wafers is further improved as compared with that in the case where the top ring has a structure that the portion used for fixing the polishing plate is only made from hard material.

As clearly understood from the above description, the apparatus for polishing wafer of the first feature according to the present invention is characterized in that work efficiency in operations of mounting or demounting the polishing plate is increased and wafers with high flatness are easily obtained since the polishing plate is separable into the two plates overlapped one on top of the other during operation.

The apparatus for polishing wafers of the second feature of the present invention realises the polishing of a pressure type of a load with uniform distribution across the polishing plate and thus flatness of wafers is improved as compared with that in the case that the lower surface of the top ring for securing the polishing plate is only made from hard material.

According to the apparatus for polishing wafers of the third feature of the present invention, the two plates constituting the polishing plate are set up on the same polishing apparatus only in the condition of being simply overlapped with each other without the use of fixturing members such as bolts.

According to the apparatus for polishing wafers of the fourth feature of the present invention, the same polishing apparatus has a structure that pressurized fluid is pressed in between the overlapped two plates through one or more of the openings arranged along the periphery of the polishing plate for introduction or removal of the pressurized fluid or adhering liquid held between the same overlapped two plates is removed by suction and thus the lower plate may be separated from the upper plates with ease.

What is claimed is:

1. An apparatus for polishing wafers comprising:

a polishing apparatus having a top ring mounted on a rotary shaft;

a wafer carrier made from a material with high rigidity for adhering wafers thereto, the wafer carrier composed of two plates including an upper plate and a lower plate which are superimposed with each other in tight adhesion, said upper plate being mounted to a lower portion of the top ring of the polishing apparatus, a total thickness of the two plates being sufficient to prevent the plates from becoming deformed by a polishing load; and a flexible thin plate secured to the lower portion of the top ring so as to form a sealed space within the top ring, the sealed space being in communication with a source of pressurized fluid and the upper plate being spaced apart and below a lower surface of the thin plate.

2. An apparatus for polishing wafers comprising:

a polishing apparatus having a top ring mounted on a rotary shaft;

a wafer carrier made from a material with high rigidity for adhering wafers thereto, the wafer carrier composed of two plates including an upper plate and a lower plate which are superimposed with each other in tight adhesion, said upper plate being mounted to a lower portion of the top ring of the polishing apparatus, a total thickness of the two plates being sufficient to prevent the plates from becoming deformed by a polishing load; and a flexible thin plate secured to the lower portion of the top ring so as to form a sealed space within the top ring, the sealed space being in communication with a source of pressurized fluid and the upper plate being spaced apart and below a lower surface of the thin plate, wherein the upper plate is mounted to the lower portion of said top ring by a hook-shaped holding member which allows the upper plate to move with respect to the lower surface of the thin plate from said spaced apart position to a position in which the upper plate contacts the lower surface of thin plate.

3. An apparatus for polishing wafers according to claim 2, wherein the upper plate is spaced apart from the lower surface of thin plate by a distance of from 0.5 mm to 5.0 mm when said upper plate rests on said hook-shaped holding member.

4. An apparatus for polishing wafers according to claim 2, wherein A is the width of an annual channel along a periphery of the upper plate, B is the thickness of the hook-shaped holding member, C is the distance at which the upper plate is spaced apart from the lower surface of thin plate when said upper plate rests on said hook-shaped holding member, and (A–B)>C.

5. An apparatus for polishing wafers according to claim 4, wherein the two plates include polished surfaces at which they are superimposed and are adhered to each other by surface tension of a provided therebetween.

6. An apparatus for polishing wafers according to claim 5, wherein at least one of the two plates includes a plurality of channels in a surface thereof at which surface the two plate are superimposed with each other, the channels being symmetrically arranged and extending between a point in a center of the water carrier and openings formed by the channels in a peripheral portion of the wafer carrier, at which openings a fluid can be supplied or withdrawn to separate the two plates.

7. An apparatus for polishing wafers according to claim 6, wherein said channels extend linearly between the center of the wafer carrier and the openings.

8. An apparatus for polishing wafers according to claim 6, wherein said channels extend in a curved manner between the center of the water carrier and the openings.

9. An apparatus for polishing wafers comprising:

a polishing apparatus having a top ring mounted on a rotary shaft; and a wafer carrier made from a material with high rigidity for adhering wafers thereto, the wafer carrier composed of two plates including an upper plate and a lower plate which are superimposed with each other in tight adhesion, said two plates including polished surfaces at which they are superimposed and being adhered to each other by surface tension of a liquid provided therebetween, said upper plate being mounted to a lower portion of the top ring of the polishing apparatus, a total thickness of the two plates being sufficient to prevent the plates from becoming deformed by a polishing load.

10. An apparatus for polishing wafers according to claim 9, wherein the liquid comprises water.

11. An apparatus for polishing wafers according to claim 9, wherein at least one of the two plates includes a plurality of channels in a surface thereof at which surface the two plates are superimposed with each other, the channels being symmetrically arranged and extending between a point in a center of the wafer carrier and openings formed by the channels in a peripheral portion of the wafer carrier, at which openings a fluid can be supplied or withdrawn to separate the two plates.

12. An apparatus for polishing wafers according to claim 11, wherein said channels extend linearly between the center of the wafer carrier and the openings.

13. An apparatus for polishing wafers according to claim 11, wherein said channels extend in a curved manner between the center of the wafer carrier and the openings.

14. An apparatus for polishing wafers comprising:

a polishing apparatus having a top ring mounted on a rotary shaft;

a wafer carrier made from a material with high rigidity for adhering wafers thereto, the wafer carrier composed of two plates including an upper plate and a lower plate which are superimposed with each other in tight adhesion, said two plates including polished surfaces at which they are superimposed and being adhered to each other by surface tension of a liquid provided therebetween, said upper plate being mounted to a lower portion of the top ring of the polishing apparatus, a total thickness of the two plates being sufficient to prevent the plates from becoming deformed by a polishing load; and a flexible thin plate secured to the lower portion of the top ring so as to form a sealed space within the top ring, the sealed space being in communication with a source of pressurized fluid and the upper plate being spaced apart and below a lower surface of the thin plate.

15. An apparatus for polishing wafers according to claim 14, wherein at least one of the two plates includes a plurality of channels in a surface thereof at which surface the two plates are superimposed with each other, the channels being symmetrically arranged and extending between a point in a center of the wafer carrier and openings formed by the channels in a peripheral portion of the wafer carrier, at which openings a fluid can be supplied or withdrawn to separate the two plates.

16. An apparatus for polishing wafers according to claim 15, wherein said channels extend linearly between the center of the wafer carrier and the openings.

17. An apparatus for polishing wafers according to claim 15, wherein said channels extend in a curved manner between the center of the wafer carrier and the openings.

* * * * *